US006581516B1

(12) United States Patent
Schönberger

(10) Patent No.: US 6,581,516 B1
(45) Date of Patent: Jun. 24, 2003

(54) DOCTOR DEVICE IN AN INKING UNIT OF A ROTARY PRINTING MACHINE

(75) Inventor: Wolfgang Schönberger, Schriesheim (DE)

(73) Assignee: Heidelberger Drückmaschinen AG, Heidelberg (DE)

( * ) Notice: Subject to any disclaimer, the term of this patent is extended or adjusted under 35 U.S.C. 154(b) by 53 days.

(21) Appl. No.: 09/686,122

(22) Filed: Oct. 11, 2000

(30) Foreign Application Priority Data

Oct. 11, 1999 (DE) ..... 199 48 931

(51) Int. Cl.[7] ..... B41F 9/10
(52) U.S. Cl. ..... 101/154; 101/153
(58) Field of Search ..... 101/154, 155, 101/156, 153, 167, 169, 157, 365, 363, 350

(56) References Cited

U.S. PATENT DOCUMENTS

| | | | | |
|---|---|---|---|---|
| 2,947,248 A | | 8/1960 | Fuchs | 101/157 |
| 3,783,781 A | | 1/1974 | Grommek | 101/157 |
| 4,381,708 A | * | 5/1983 | Hirt et al. | 101/365 |
| 5,138,944 A | * | 8/1992 | Rancourt et al. | 101/365 |
| 5,287,808 A | * | 2/1994 | Lippold | 101/365 |
| 5,656,083 A | * | 8/1997 | Schonberger | 118/107 |
| 5,799,579 A | * | 9/1998 | Schlegel | 101/365 |
| 6,450,097 B1 | * | 9/2002 | Kistler et al. | 101/483 |

FOREIGN PATENT DOCUMENTS

| | | | |
|---|---|---|---|
| DE | 23 27 383 A1 | | 1/1975 |
| DE | 3727656 A1 | * | 3/1989 |
| DE | 39 14 831 A1 | | 11/1990 |
| DE | 41 15 026 A1 | | 11/1992 |
| DE | 92 16 754.3 | | 3/1993 |
| DE | 44 25 478 A1 | | 2/1996 |
| DE | 296 00 219 U1 | | 4/1996 |
| EP | 0 788 877 A1 | | 8/1997 |

* cited by examiner

*Primary Examiner*—Anthony H. Nguyen
(74) *Attorney, Agent, or Firm*—Laurence A. Greenberg; Werner H. Stemer; Ralph E. Locher

(57) ABSTRACT

A doctor device in an inking unit of a rotary printing machine, having a base member, and a working doctor adjustable with respect to the base member, includes a sensor for determining a position of the working doctor relative to the base member; and a rotary printing machine includes the doctor device.

23 Claims, 4 Drawing Sheets

DOCTOR DEVICE IN AN INKING UNIT OF A ROTARY PRINTING MACHINE

BACKGROUND OF THE INVENTION

Field of the Invention

The invention relates to a doctor device, in particular a chamber-type doctor device, in an inking unit of a rotary printing machine, having a base member and a working doctor adjustable with respect to the base member.

In rotary printing machines, inking units have become known heretofore which have a doctor device with a working doctor associated therewith, the working doctor resting on the surface of an engraved or screen roller formed with dimple-like or groove-like depressions, or on the engraved surface of a gravure printing roller. As a result, for example when using the engraved or screen roller, the ink or other coating material is doctored or squeezed off the webs located between the depressions on the rotating engraved or screen roller, while the ink in the depressions in the engraved or screen roller passes by the working doctor. Because the working doctor lies under a given prestress on the rotating engraved or screen roller, the working doctor is subjected to continual wear. The working doctor is thereby shortened, resulting in a reduction of the prestress below a minimum value, which requires the working doctor to be reset or, if there is no resetting option, to be renewed.

The working doctor can be reset by resilient elements, which press the doctor blade, which is resettable in a guide, against the ink-carrying roller, and thereby automatically compensate for the wear of the doctor blade. However, in this regard, the difficulty arises of adapting the setting force provided by the resilient elements to the changing operating conditions of the printing machine. When the printing machine is stopped, the working doctor must initially be set against the roller, it being necessary for the doctor blade to be pushed back in the guide counter to the setting force of the resilient elements, and to prevent the doctor blade from bending. In order to doctor or squeeze off the surface of the ink-carrying roller cleanly, the working doctor must lie on this roller at a given angle. If this angle is chosen too small, i.e., the doctor blade lies too flat on the roller, the doctor blade can then slip on the surface of the roller and be reset to too great an extent by the maximally outsprung resilient elements, so that the surface is doctored or squeezed off rather poorly. If, by contrast therewith, the angle between the doctor blade and the surface is chosen too large, the doctor blade is then pushed back in the guide, due to the higher dynamic pressure of the ink resulting therefrom, and the doctoring result is likewise impaired. The permissible angle between the doctor blade and the roller therefore lies in a narrowly limited angular range, and the setting force provided by the resilient elements must correspondingly lie in a likewise narrowly limited range. When the printing speed is increased, however, the dynamic pressure of the ink increases, and the doctor blade is pushed back in the guide counter to the setting force of the resilient elements, due to which the doctoring result is impaired.

As a result of the penetration of the ink into the doctor guide and the drying of the ink therein, the frictional force of the doctor blade in the guide is increased, causing the setting force to be reduced and the doctoring result to be impaired likewise. It is therefore not possible to set the doctor blade at the correct angle against the ink-carrying roller in all the operating conditions of the printing machine, by using the resilient elements.

The published German Petty Patent Document DE 92 16 754 U1 describes a doctor bar in a short-form inking unit, which has a device comprising a base member and a working doctor, which permits the working doctor to be pressed controllingly against an engraved or screen roller at a negative setting angle. In the described device, the working doctor is set manually against the engraved or screen roller on a straight line extending parallel to the setting angle of the doctor blade.

With the aid of springs or hydraulic or pneumatic operating cylinders, continuous resetting is achieved during the operation of the printing machine, the service life of the doctor blade being thereby increased. In this case, the problems mentioned hereinabove regarding the force-controlled setting of the doctor blade against the engraved roller occur.

In the published German Patent Document DE 44 25 478 A1, a chamber-type doctor device is shown wherein a working doctor is fixed to a holder that is mounted so that it is pivotable on a chamber-type doctor member, the working doctor being pressed against a cylinder due to the exertion of a force upon the pivotable holder by a spring.

Because no guide slot is required for the doctor blade in this construction of the chamber-type doctor device, it is not possible for the doctor blade to stick in a guide slot and, consequently, for a reduction in the setting force to occur. However, the aforementioned problems occurring during the setting of the working doctor and at variable printing speeds exist, nevertheless, as before.

One solution of the problem would be to press the working doctor against the roller by resetting or adjusting screws, so that the doctor blade is prevented from being sprung out or pushed back uncontrollingly, because the doctor blade is held in the guide thereof in a position permanently defined by the resetting screws. However, the pressman must then be given the possibility of monitoring or controlling the attrition of the doctor blade caused by the wear, in order to reset the doctor blade manually, as required.

Hereinafter, reference to an inking unit with an engraved or screen roller should always be considered to be by way of example. The invention, however, is not restricted to inking units with an engraved or screen roller, but is also installable, for example, in inking units with a gravure printing roller.

SUMMARY OF THE INVENTION

Thus, there is provided, in accordance with the invention, a doctor device in an inking unit of a rotary printing machine, which has a simple construction and with which it is possible for a pressman to determine the then-occurring wear of the working doctor in a reproducible manner, and to facilitate the tracking of the working doctor into an optimal operating position.

With the foregoing and other objects in view, there is provided, in accordance with one aspect of the invention, a doctor device in an inking unit of a rotary printing machine, having a base member, and a working doctor adjustable with respect to the base member, comprising a sensor for determining a position of the working doctor relative to the base member.

In accordance with another feature of the invention, the sensor includes a first electric circuit, the position of the working doctor relative to the base member being determinable by respective opening and closing of the first circuit.

In accordance with a further feature of the invention, a contact is included in the first circuit for closing the first circuit when the working doctor is in a first nominal or desired position.

In accordance with an added feature of the invention, the contact is located on a side wall of the base member.

In accordance with an additional feature of the invention, the first circuit includes a first indicating device, which is activated when the first circuit is closed.

In accordance with yet another feature of the invention, the first indicating device is a control lamp.

In accordance with yet a further feature of the invention, the sensor includes a second electric circuit, the first circuit being closed and the second circuit being open when the working doctor is in a first nominal position, and the first circuit being open and the second circuit being closed when the working doctor is in a second position.

In accordance with yet an added feature of the invention, the first circuit has assigned thereto a first measuring finger with a first contact, and the second circuit has assigned thereto a second measuring finger with a second contact, the first measuring finger and the second measuring finger being disposed so that, in the first position, the working doctor engages the first contact and closes the first circuit, and, in the second position, the working doctor engages the second contact and closes the second circuit.

In accordance with yet an additional feature of the invention, the first circuit has a first indicating device assigned thereto, the first indicating device being activatable when the first circuit is closed.

In accordance with still another feature of the invention, the second circuit has a second indicating device assigned thereto, the second indicating device being activatable when the second circuit is closed.

In accordance with still a further feature of the invention, at least one of the first and the second indicating devices is a control lamp.

In accordance with a first alternative feature of the invention, the sensor is a distance sensor for virtually continuously measuring the distance between the working doctor and the base member of the doctor device.

In accordance with a second alternative feature of the invention, the distance sensor is an inductive sensor for inductively determining the distance between the working doctor and the base member of the doctor device.

In accordance with a third alternative feature of the invention, the distance sensor is a capacitive sensor for capacitively determining the distance between the working doctor and the base member of the doctor device.

In accordance with a fourth alternative feature of the invention, the distance sensor is an ultrasonic sensor for determining the distance between the working doctor and the base member of the doctor device by ultrasound.

In accordance with still an added feature of the invention, the distance sensor is electrically connected to a device for indicating an instantaneous position of the working doctor.

In accordance with still an additional feature of the invention, the doctor device includes a tracking device for moving the working doctor by motor.

In accordance with another feature of the invention, the working doctor is trackable in a closed control circuit based upon a position of the working doctor determinable by the sensor.

In accordance with a further feature of the invention, the position of the working doctor is mechanically determinable by the distance sensor via a sensing head resting on the working doctor.

In accordance with an added feature of the invention, the doctor device includes a pointer for indicating the position of the working doctor in magnified form on a scale associated with the pointer, the distance sensor being mechanically coupled with the pointer.

In accordance with another aspect of the invention, there is provided a rotary printing machine including a doctor device in an inking unit of the rotary printing machine, having a base member, and a working doctor adjustable with respect to the base member, comprising a sensor for determining a position of the working doctor relative to the base member.

In accordance with a concomitant feature of the invention, the position of a tip of the working doctor relative to the base member is determinable by the sensor.

Thus, the doctor device according to the invention is distinguished by the fact that the position of the working doctor relative to the base member is determined by a sensor. The position of the working doctor relative to the base member of the doctor device, which changes as a result of wear, is measured objectively, so that, based upon the fixed, unchanging position of the base member of the doctor device relative to the engraved or screen roller, a determination of the relative position of the working doctor with respect to the engraved or screen roller is permitted. The working doctor can be located in a position referred to hereinafter as a "first position", wherein it is set against the engraved or screen roller in a manner that the ink is doctored or squeezed off the engraved or screen roller with the desired result, i.e., so that the depressions in the surface of the engraved or screen roller are completely filled with ink, and the bars or cross-pieces between the depressions are free of ink.

Therefore, in the first position, the working doctor has a predefined length and rests on the engraved or screen roller at a predefined location, at a predefined setting angle and with a predefined setting force.

Furthermore, the working doctor, as described hereinafter, can also be located in a position referred to as a "second position", in which the length thereof has been shortened, for example by wear, below a predefined minimum dimension, so that the ink is no longer doctored or squeezed off the engraved or screen roller with the desired result, in particular at high continuous printing speeds, i.e., the bars or cross-pieces between the depressions are no longer free of ink.

The aforedescribed embodiments of the invention provide the advantage that the resetting of the working doctor from the second position to the first position can be performed controllingly. The working doctor is adjustable by hand or by motor by rotating resetting screws, and the setting force is adjustable. By using resetting screws, the disadvantages of the working doctor pushing back when, for example, resilient elements are used, are avoided, and the influence upon the setting force resulting from the working doctor sticking in the guide, is eliminated. In addition, due to the possibility for controlled resetting or readjustment of the working doctor, the necessity for dismantling the doctor device in order to reset the working doctor is avoided, it being possible to reset the working doctor, in particular, even during continuous production.

Furthermore, provision can be made for allowing the resetting screws not to act directly on the working doctor, but to hold the working doctor in a clamping bar and to press against the clamping bar with the resetting screws.

In this regard, the sensor can preferably comprise a circuit which is completed or closed when the working doctor is in the first position. A contact can accordingly be provided which comprises, on the one hand, the electrically conductive working doctor and, on the other hand, a contact location on the doctor device. As a result of the resetting of the working doctor, the latter is brought into the first position, wherein it engages the contact location and completes or closes the circuit. In a preferred embodiment of the invention, the contact location is located, in particular, on a side wall of the doctor device, the side wall being fitted or applied to the base member in an electrically insulating manner and being electrically conductive. The engraved or screen roller usually has a ceramic coating, which acts in an electrically insulating manner and therefore does not have a disruptive influence on the current flow from the working doctor via the contact location to the side wall of the chamber-type doctor. This results in a doctor device which is very simple to produce, because, in order to install the contact location, recourse can be had to existing components of the doctor device.

In a further refinement of the invention, when the circuit is completed or closed, it may be possible for an indicating device, which in very simple form is a control lamp, to be activated. The activated indicating device, which can also produce an acoustic signal, in addition, signals to the pressman that the working doctor is in the first position. Through the intermediary of a deactivated indicating device, for example an extinguished control lamp, a signal is given to the pressman that tracking the working doctor is necessary until the indicating device is reactivated.

According to a further embodiment of the doctor device according to the invention, the doctor device comprises a second circuit, which is completed or closed when the working doctor reaches the second position as a result of a length change brought about by wear. This second circuit is advantageously likewise provided with a contact, which is formed of the electrically conductive working doctor and a contact location on the doctor device. For this purpose, a preferred embodiment of the doctor device preferably comprises two electrically conductive measuring fingers, which are fitted or applied in an electrically insulating manner to the base member of the doctor device and whereon the two contact surfaces are arranged, with which the working doctor can be brought into contact. In this regard, in the first position, the working doctor engages the contact location of the first measuring finger and, in the second position, engages the contact location of the second measuring finger. The two measuring fingers preferably have small dimensions, so that the ink flow in the interior of the doctor device is not impeded.

According to a further embodiment of the invention, both circuits are equipped with indicating devices, for example two control lamps. The second circuit can be equipped with an additional buzzer. The first indicating device is activated when the first circuit is completed or closed by contact between the reset working doctor and the first contact location, and the second indicating device and the additional buzzer are activated when the second circuit is completed or closed by contact between the worn working doctor and the second contact location. When the second indicating device is activated and the additional buzzer is activated, i.e., when the working doctor is in the second position, it is accordingly possible for the working doctor to be reset, i.e., displaced, until the second indicating device and the buzzer are deactivated and the first indicating device is activated again when the first position is reached, it then being possible for a further non-illustrated buzzer in the first circuit, for example, to buzz as well at a different frequency. If neither of the two indicating devices nor the additional buzzer is activated, the working doctor is in a central position between the first position and the second position, wherein a result corresponding to the requirements is obtained.

A further refinement of the invention, wherein a distance sensor measures the distance between the working doctor and the base member of the doctor device virtually continuously, offers the advantage that the position of the working doctor relative to the base member is measured not only in the two limiting positions, i.e., the first position and the second position, but that the position of the working doctor, which changes continuously as a result of wear, can additionally be measured in any other desired position between the two limiting positions. In this embodiment of the invention, too, the distance sensor is expediently connected electrically to an indicating device to indicate the instantaneous position of the working doctor, as a result of which the pressman is continually informed about the wear of the respective doctor, without having to carry out an often problematical visual check of the corresponding doctor blade, for this purpose. In order to measure the position of the working doctor, the distance sensor can be located in the interior of the doctor device or in an exterior space. In addition, the distance sensor can also indicate the position of the working doctor relative to the base member of the chamber-type doctor mechanically, by a pointer. In this case, the resulting advantage is that, in order to indicate the position of the working doctor, no current-carrying components are needed, and therefore the indicating device does not become susceptible to disturbances to the current flow in the region of the chamber-type doctor which is loaded with ink to a great extent, and that the engraved or screen roller can be produced from an electrically conductive material.

Furthermore, the distance sensor can be constructed as an inductive sensor, as a capacitive sensor or as an ultrasonic sensor, the sensor in each of these embodiments advantageously being connected electrically to an indicating device, for example an analog or digital indicating device, which indicates the position of the working doctor.

In addition, there is the possibility of constructing the distance sensor as a capacitive sensor which, for example, can be implemented by applying an alternating electric field to the working doctor and to the side wall or to the measuring fingers, in order to measure a distance-dependent capacitance between the working doctor and the side wall or the measuring fingers.

Furthermore, provision can be made for the doctor device to comprise a tracking device, with which the working doctor can be moved by motor. The use of a tracking device is particularly advantageous if the tracking is carried out by a control device in a closed control circuit or loop based upon the position of the working doctor determined by the sensor. In this regard, the control device can start and stop the motorized resetting when the working doctor is detected by the distance sensor in the second and in the first position, respectively. In this regard, the working doctor is moved from the first position into the second position as a result of the shortening thereof caused by wear and, after reaching the second position, is moved back from the latter into the first position through a motorized resetting thereof.

Other features which are considered as characteristic for the invention are set forth in the appended claims.

Although the invention is illustrated and described herein as embodied in a doctor device in an inking unit of a rotary printing machine, it is nevertheless not intended to be limited to the details shown, since various modifications and structural changes may be made therein without departing from the spirit of the invention and within the scope and range of quivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
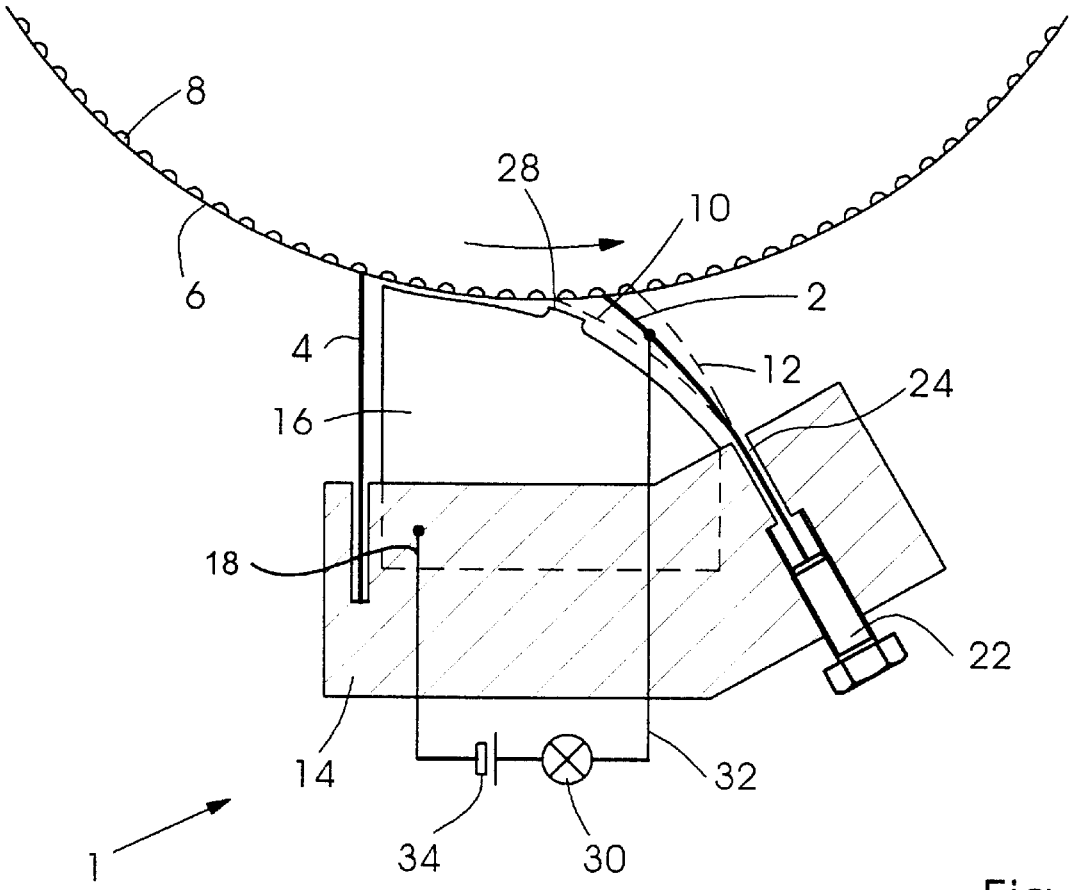
FIG. 1 is a diagrammatic and schematic view, partly in section, of a chamber-type doctor device according to the invention, having a resettable working doctor with a side wall thereof provided with a contact location, an electric circuit being formed by the working doctor together with the side wall, a current source and an indicating device.

Referring now to the figures of the drawings and, first, particularly to FIG. 1 thereof, there is shown therein a first embodiment of a chamber-type doctor device 1 according to the invention for doctoring or squeezing printing ink off a surface of a rotating engraved or screen roller 6 formed with dimple-like depressions 8, the doctor device 1 being provided in an inking unit of a rotary printing machine and including a base member 14, having arranged thereon a closing doctor 4 and a side wall 16, which is electrically insulated with respect to the base member 14 by an insulator 18. Also provided on the base member 14 is a working doctor 2, which is displaceably guided in guides 24 with respect to the engraved or screen roller 6 by a resetting screw 22. The working doctor 2 is formed of an electrically conductive material, for example steel, and, together with the side wall 16, which is electrically conductive, although insulated by a suitable coating or the like 18 from the base member 14, and with a current source 34 and a control lamp 30, forms a circuit 32, which is opened and closed, depending upon the position of the working doctor 2, at the contact location 28 between the working doctor 2 and the side wall 16. When the working doctor 2 is in a first position 10 (illustrated by a broken line), wherein the working doctor 2 assumes a desired position with respect to the engraved or screen roller 6, the working doctor 2 engages the side wall 16 at the contact location 28, as a result of which the circuit 32 is completed and the control lamp 30 is activated. On the other hand, if the working doctor 2 is in a second position 12 (also illustrated by a broken line), into which it passes due to a shortening of the doctor blade caused by wear, then the circuit 32 is broken at the contact location 28 and the control lamp 30 is deactivated.

Figure 2:
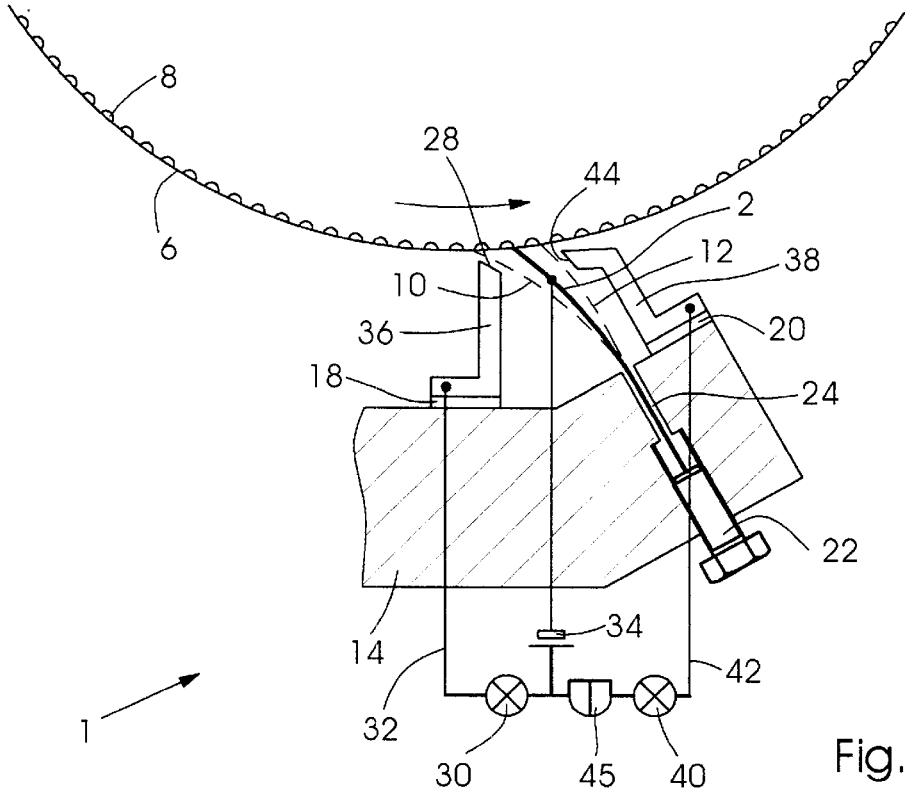
FIG. 2 is a view like that of FIG. 1 of another embodiment of the invention wherein the chamber-type doctor device has two measuring fingers which are arranged thereon and which, respectively, together with an appertaining indicating device, a common current source and a resettable working doctor, form a circuit.

A further embodiment of a chamber-type doctor 1 according to the invention, as shown in FIG. 2, includes a base member 14, on which there is arranged a working doctor 2 which rests on the engraved or screen roller 6 and is adjustable in a guide slot 24 by a resetting or adjusting screw 22. Also provided on the base member 14 are two electrically conductive measuring fingers 36 and 38, which are applied, in an electrically insulating manner, to the base member 14 via appertaining insulators 18 and 20 and which, respectively, together with the adjustable and electrically conductive working doctor 2, the current source 34 and with the measuring fingers 36 and 38 and the associated control lamps 30 and 40, form first and second circuits 32 and 42. When the working doctor 2 is in the first position 10 illustrated by a broken line, the working doctor 2 engages the first measuring finger 36 and the contact location 28, as a result of which the first circuit 32 is closed and the first control lamp 30 is activated. On the other hand, when the working doctor 2 is in the second position 12 illustrated by a broken line, then the working doctor 2 engages the second measuring finger 38 at the appertaining contact location 44, as a result of which the second circuit 42 is closed and the second control lamp 40 is therefore activated. The two control lamps 30 and 40 can advantageously be colored, for example green and red, by which a rapid visual monitoring or check as to the position of the working doctor 2 is further facilitated, inasmuch as the working doctor 2 is in the first position 10 when the green control lamp 30 is activated and, when the red control lamp 40 is activated, resetting of the working doctor 2 from the second position 12 to the first position 10 is necessary. In addition, a buzzer 45 can be integrated into the second circuit 42, so that the pressman can be additionally notified acoustically regarding the need for resetting the working doctor 2.

Figure 3:
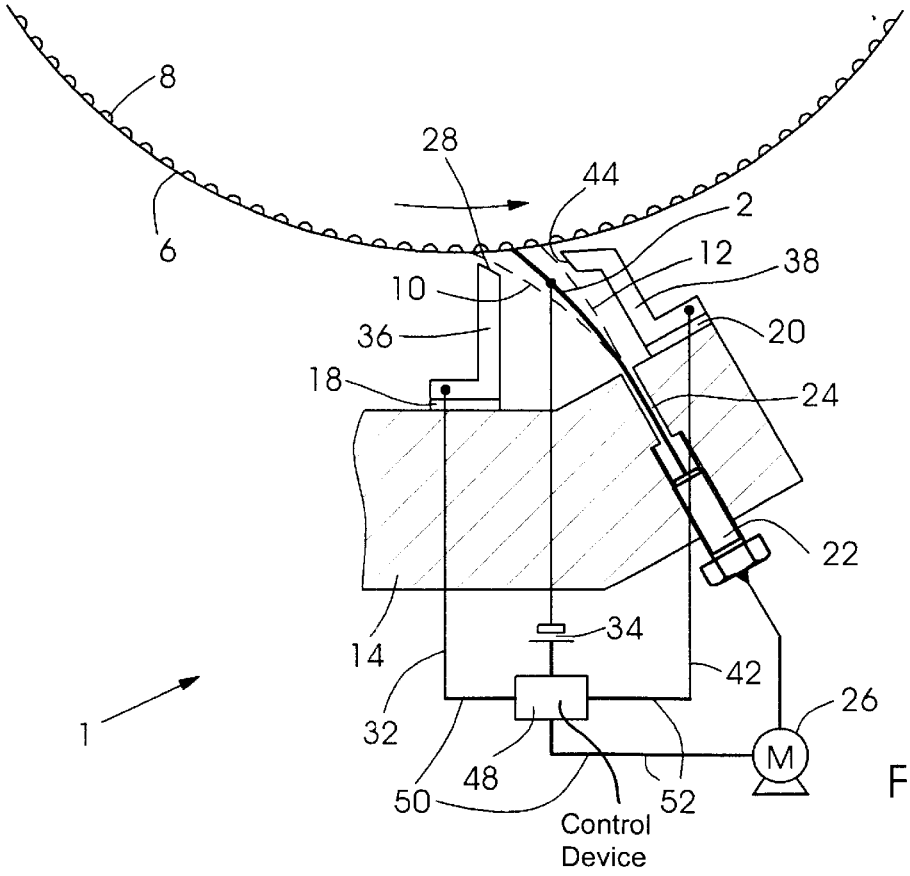
FIG. 3 is a view like those of FIGS. 1 and 2 of a further embodiment of the invention wherein the chamber-type doctor device is provided with two measuring fingers, a control device and a motor for a controlled motorized resetting of the working doctor.

In the embodiment of the chamber-type doctor device 1 according to the invention that is illustrated in FIG. 3, the working doctor 2 can be adjusted via a resetting screw 22 that is rotatable by a motor 26. The two electrically conductive measuring fingers 36 and 38, respectively, together with the electrically conductive working doctor 2, the common current source 34 and a common control device 48, form first and second control circuits SO and 52 for tracking the working doctor 2. If the working doctor 2 is located, for example, in the second position 12 and engages the contact location 44 of the second measuring finger 38, the control device 48 begins the resetting by motor which, by rotating the resetting screw 22 in the appropriate direction of rotation, moves the working doctor 2 out of the second position 12 into the first position 10. If the working doctor 2 reaches the first position 10 and engages the contact location 28 of the first measuring finger 36, the control device 48 switches off the motorized resetting.

Figure 4:
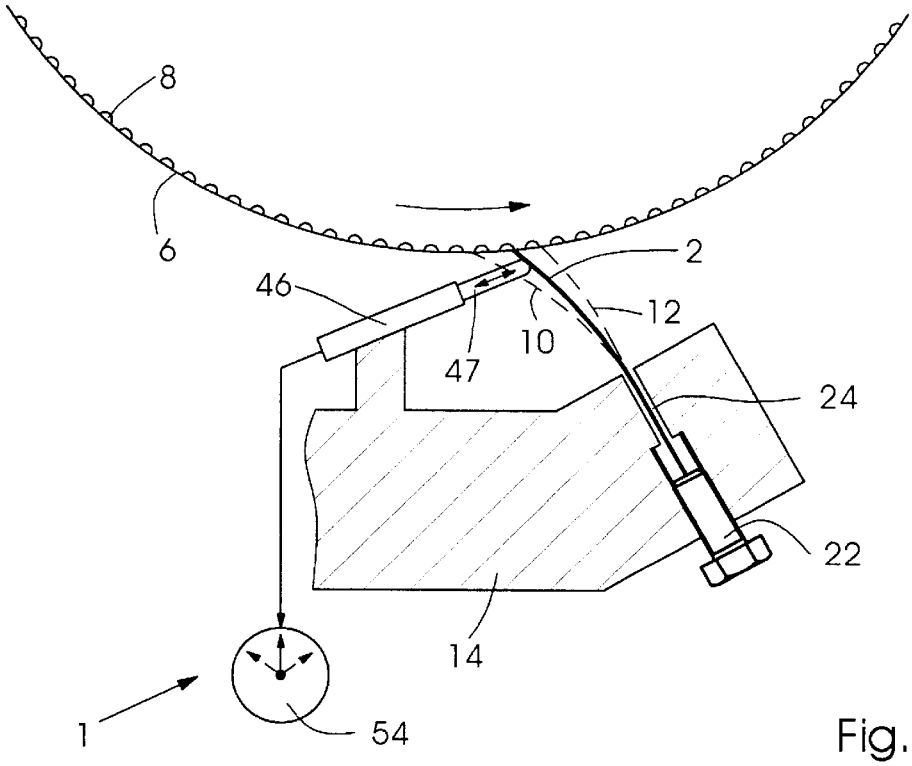
FIG. 4 is a view like those of FIGS. 1 to 3 of an added embodiment of the invention wherein the chamber-type doctor device includes a distance sensor electrically connected to an indicating device.

In the embodiment of the chamber-type doctor device 1 according to the invention that is shown in FIG. 4, a distance sensor 46, for example a mechanically acting feeler, is arranged on the base member 14 of the chamber-type doctor device 1. A sensing head 47 of the feeler preferably rests directly on the working doctor 2 and follows the position changes of the working doctor 2. An indicating device 54 that is connected electrically to the distance sensor 46 is constructed, in this embodiment of the invention, so that it can indicate all the positions of the working doctor between the first position 10 shown as a broken line, and the second position 12 shown as a broken line, both of those positions being measured by the distance sensor 46.

Figure 5:
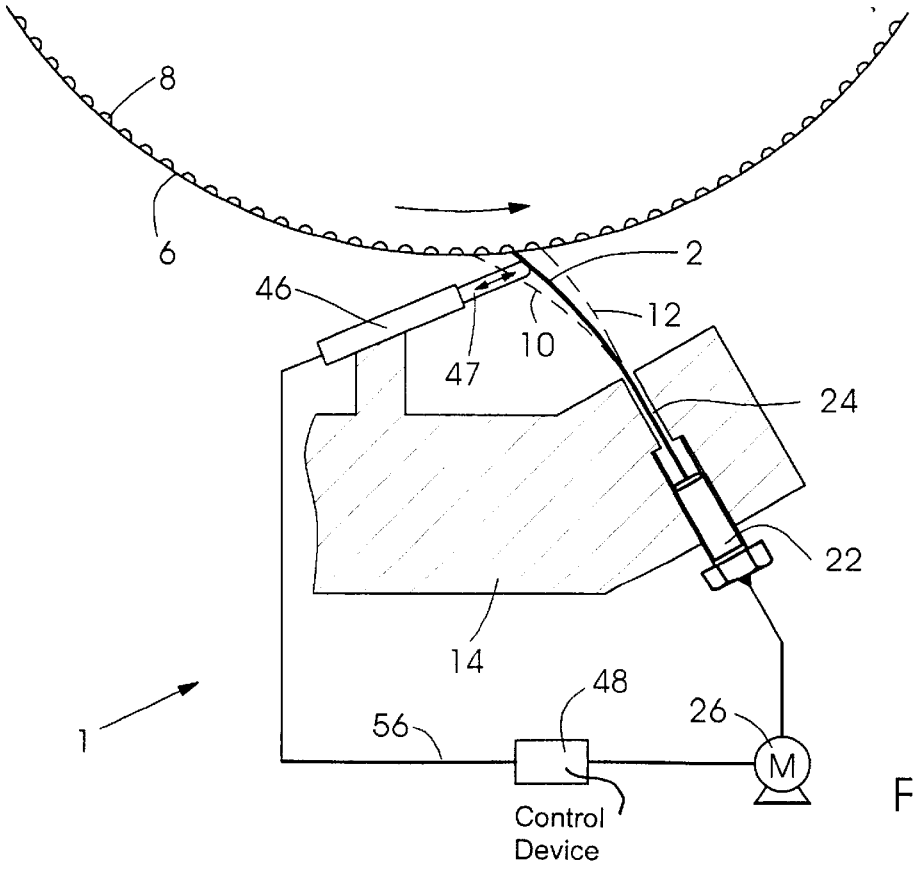
FIG. 5 is a view like those of FIGS. 1 to 4 of an additional embodiment of the invention wherein the chamber-type doctor device is provided with a distance sensor, a control device and a motor for a controlled motorized resetting of the working doctor.

FIG. 5 shows a further embodiment of the chamber-type doctor device 1 according to the invention, wherein the working doctor 2 is adjustable in a guide slot 24 by a resetting screw 22 that is rotatable by a motor 26. A distance sensor 46, for example a mechanically acting feeler, is in continuous contact with the working doctor 2 and, together with a control device 48, the motor 26 and the working doctor 2, forms a closed control circuit or loop 50. When the working doctor 2 is in the second position 12, the control device 48 begins the motorized resetting, as a result of which the working doctor 2 is moved into the first position 10, and the control device 48 ends the resetting operation. This results in only very small changes in the angle at which the working doctor 2 is set against the engraved or screen roller 6.

Figure 6:
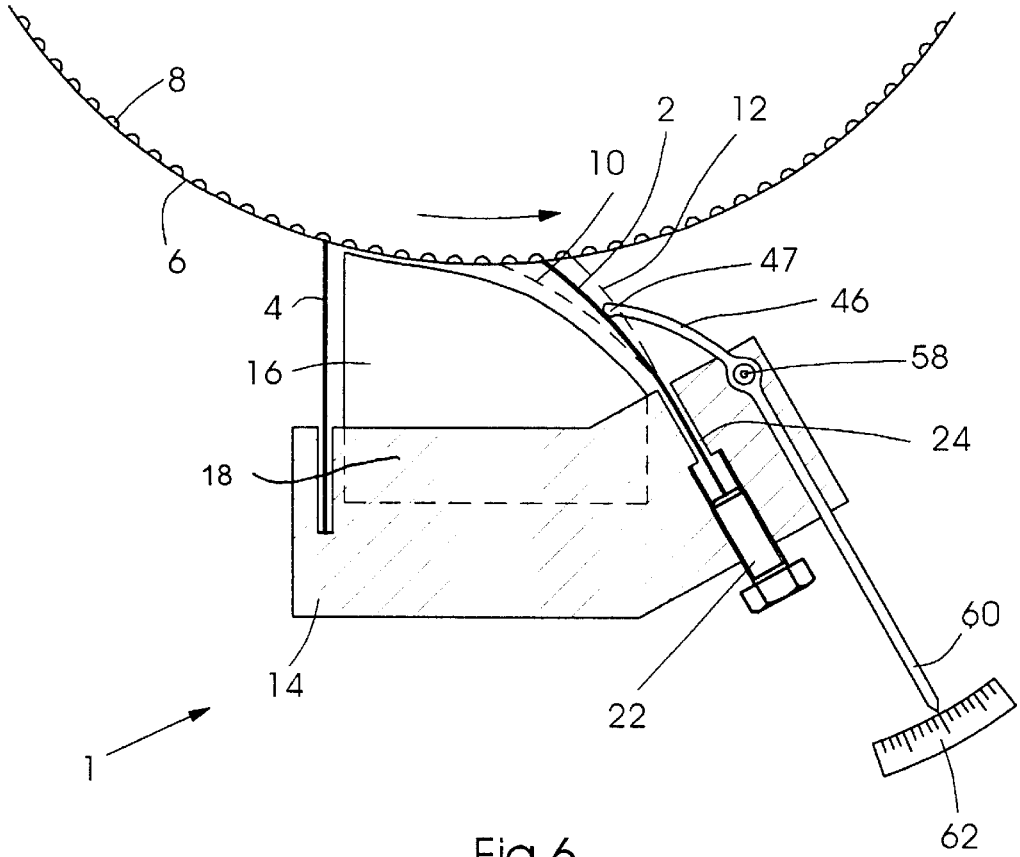
FIG. 6 is a view like those of FIGS. 1 to 5 of yet another embodiment of the invention wherein the chamber-type doctor device includes a mechanical indicating device.

The further embodiment of the chamber-type doctor device 1 according to the invention that is illustrated in FIG. 6 comprises a base member 14, a working doctor 2 which is adjustable in a guide slot 24 by a resetting screw 22, a side wall 16, a closing doctor 4 and a distance sensor 46. In order to determine the position of the working doctor 2 relative to the base member 14 of the chamber-type doctor device 1, the sensing head 47 of the distance sensor 46, which is arranged on the base member 14 so that it is rotatable about a pivot 58, preferably rests directly on the working doctor 2. The movement of the working doctor 2 from the first position 10 to the second position 12, and any other movement of the working doctor 2, is displayed in magnified form via an elongated pointer 60 on a scale 62, and in this way can easily be read by the pressman.

I claim:

1. A doctor device in an inking unit of a rotary printing machine having a roller, the doctor device comprising:

a base member;

a working doctor adjustable with respect to the base member, said working doctor having a first position and a second position relative to said base member, in said first position said working doctor being set against the roller for doctoring ink in a desired result, in said second position said working doctor being set against the roller for stopping doctoring ink in the desired result;

a sensor determining a respective one said first and second positions of said working doctor relative to said base member; and an indicating device connected to said sensor, said indicating device being activated by said sensor dependent on a determined one of said first and second positions of said working doctor relative to said base member.

2. The doctor device according to claim 1, wherein:

said sensor includes a first electric circuit having open state and close state; and said open state and said close state determining the respective one of said first and second positions of said working doctor relative to said base member.

3. The doctor device according to claim 2, wherein said first circuit includes a contact for closing said first circuit when said working doctor is in said first position.

4. The doctor device according to claim 3, wherein said base member has a side wall and said contact is located on said side wall of said base member.

5. The doctor device according to claim 2, wherein said first circuit includes a first indicating device, which is activated when said first circuit is closed.

6. The doctor device according to claim 5, wherein said first indicating device is a control lamp.

7. The doctor device according to claim 2, wherein said sensor includes a second electric circuit, said first circuit being closed and said second circuit being open when said working doctor is in said first position, and said first circuit being open and said second circuit being closed when said working doctor is in said second position.

8. The doctor device according to claim 7, wherein said first circuit has assigned thereto a first measuring finger with a first contact, and said second circuit has assigned thereto a second measuring finger with a second contact, said first measuring finger and said second measuring finger being disposed so that, in said first position, said working doctor engages said first contact and closes said first circuit, and, in said second position, said working doctor engages said second contact and closes said second circuit.

9. The doctor device according to claim 7, wherein said first circuit has a first indicating device assigned thereto, said first indicating device being activatable when said first circuit is closed.

10. The doctor device according to claim 7, wherein said second circuit has a second indicating device assigned thereto, said second indicating device being activatable when said second circuit is closed.

11. The doctor device according to claim 10, wherein at least one of said first and said second indicating devices is a control lamp.

12. The doctor device according to claim 1, wherein said sensor is a distance sensor for virtually continuously measuring a distance between said working doctor and said base member of the doctor device.

13. The doctor device according to claim 12, wherein said distance sensor is an inductive sensor inductively determining the distance between said working doctor and said base member of the doctor device.

14. The doctor device according to claim 12, wherein said distance sensor is a capacitive sensor capacitively determining the distance between said working doctor and said base member of the doctor device.

15. The doctor device according to claim 12, wherein said distance sensor is an ultrasonic sensor determining the distance between said working doctor and said base member of the doctor device by ultrasound.

16. The doctor device according to claim 12, wherein said distance sensor is electrically connected to a device for indicating an instantaneous position of said working doctor.

17. The doctor device according to claim 1, including a tracking device for moving the working doctor by motor.

18. The doctor device according to claim 17, wherein the working doctor is trackable in a closed control circuit based upon a position of the working doctor determinable by said sensor.

19. The doctor device according to claim 12, wherein the respective position of said working doctor is mechanically determinable by said distance sensor via a sensing head resting on said working doctor.

20. The doctor device according to claim 19, including a pointer for indicating the position of the working doctor in magnified form on a scale associated with said pointer, said distance sensor being mechanically coupled with said pointer.

21. The doctor device according to claim 1, wherein said working doctor has a tip and said sensor determines the position of said tip of said working doctor relative to said base member.

22. A rotary printing machine, comprising:

a roller;

an inking unit with a doctor device having:

a base member;

a working doctor adjustable with respect to the base member, said working doctor having a first position and a second position relative to said base member, in said first position said working doctor being set against the roller for doctoring ink in a desired result, in said second position said working doctor being set against the roller for stopping doctoring ink in the desired result;

a sensor determining a respective one said first and second positions of said working doctor relative to said base member; and an indicating device connected to said sensor, said indicating device being activated by said sensor dependent on a determined one of said first and second positions of said working doctor relative to said base member.

23. A rotary printing machine including a doctor device in an inking unit of the rotary printing machine having a roller, the doctor device comprising:

a base member;

a working doctor adjustable with respect to the base member, said working doctor having a first position and a second position relative to said base member, in said first position said working doctor being set against the roller for doctoring ink in a desired result, in said second position said working doctor being set against the roller for stopping doctoring ink in the desired result;

a sensor determining a respective one said first and second positions of said working doctor relative to said base member; and a tracking device connected to said sensor, said tracking device being activated by said sensor dependent on a determined one of said first and second positions of said working doctor relative to said base member for moving said working doctor by a motor.

* * * * *